United States Patent [19]

Huang

[11] Patent Number: 4,964,177

[45] Date of Patent: Oct. 23, 1990

[54] BUSTDART-FREE TAILORING PROCESS FOR A FITTED-WAIST DRESS TO ELIMINATE CUTTING OF ITS BACKPIECE

[76] Inventor: Ding S. Huang, No. 9-16, Lane 344, Nanking W. Rd., Taipei, Taiwan

[21] Appl. No.: 227,724

[22] Filed: Aug. 3, 1988

[51] Int. Cl.[5] ..... A41D 27/00; A41H 3/00

[52] U.S. Cl. ..... 2/243 B; 2/243 R

[58] Field of Search ..... 2/243 R, 243 A, 243 B; 450/39, 40

[56] References Cited

U.S. PATENT DOCUMENTS

| | | | |
|---|---|---|---|
| 2,797,415 | 7/1957 | Spanel et al. | 450/39 |
| 3,434,478 | 3/1969 | Liebowitz et al. | 450/39 |
| 3,763,499 | 10/1973 | Bartos et al. | 2/243 R |
| 3,801,277 | 4/1974 | Gamarra et al. | 2/243 R |
| 3,811,131 | 5/1974 | Gamarra et al. | 2/243 B |

FOREIGN PATENT DOCUMENTS

| | | | |
|---|---|---|---|
| 2322557 | 9/1975 | France | 450/40 |
| 1577099 | 10/1980 | United Kingdom | 450/40 |

*Primary Examiner*—Werner H. Schroeder

*Assistant Examiner*—Jeanette E. Chapman

*Attorney, Agent, or Firm*—Bucknam and Archer

[57] ABSTRACT

A bustdart-free tailoring process for a fitted-waist dress having armpits, made of a woven cloth having warp and weft yarns, and designed so as to eliminate cutting of the back piece, is performed by steam-warming and wet-treating a predetermined area of the woven cloth to make the warp and waft yarns more flexible for subsequent realignment thereof, setting a pre-arranged point within the predetermined area to serve as curvature centroid, stretch-ironing bilaterally and outwardly from a line connecting a preselected point with a preselected armpit point along curvature paths conforming with said curvature centroid, thereafter heat-treating the warp and weft yarns within the predetermined area so as to re-align the yarns toward the prearranged point, and one-way permanent-pressing at least a pre-arranged area of the cloth towards the preselected point so as to let at least a preselected portion of the cloth form a preselected curvature. The process also provides for eliminating the cutting of the back waist portion.

2 Claims, 5 Drawing Sheets

| PROCESS | PATTERN | GARMENT |
|---|---|---|
| 1) Determine bust dart opening and cut a pattern. | (A) | |
| 2) Merge the bust dart portion and set a shifted pattern. | (A) | |
| 3) Tailor a front piece according to the shifted pattern. | | (AA) |
| 4) Proceed with stretched ironing and permanent press treatment. | | (AA) |
| 5) Detect the standard size of the armhole between two peak points and set a false stitch. | | (AA) |
| 6) Complete tailoring of the front piece. | | (AA) |
| 7) Based on the back central line determined the preferred curved line below the back armpit, cut a pattern and tailor a back-piece according to the pattern obtained. | (B) | (BB) |
| 8) Based on a central point on the waistline proceed with stretched iroing and permanent press treatment. | | (BB) |
| 9) Complete tailoring of the back piece. | | (BB) |

FIG:1

BUSTDART-FREE TAILORING PROCESS FOR A FITTED-WAIST DRESS TO ELIMINATE CUTTING OF ITS BACKPIECE

BACKGROUND OF THE INVENTION

A bust dart-free tailoring process to eliminate back cutting for a dress with fitted waist, and more particularly a one-piece dress tailoring process to provide proper curvature on the bust and the back waist portion to fit a human body without letting the cloth grain to be twisted or destroyed due to a dart arranging or cutting process.

Regular dress tailoring methods are mainly adopted from the papers issued by Japan or some other countries. However, the dress for women's wear should provide a bust dart to form a fitting curvature and should be cut to reduce the waist to fit a human body. This tailoring method requires dart and cutting and is not applicable with a striped fabric, checkered or patterned cloth since the pattern of the cloth will be distorted.

The object of the present invention is to overcome the problems of regular tailoring methods.

The main object of the present invention is to provide a tailoring process so that a dress made according to the present tailoring process can provide a proper curvature on the bust and the back waist portion to fit a human body and the entire beauty of the grain of the cloth used will not be destroyed due to dart arranging or cutting.

Another object of the present invention is to provide a dress tailoring process to upgrade dress tailoring technique, to let the dress made according to the present invention be more attractive while worn, and to increase the added value:

BRIEF DESCRIPTION OF THE DRAWINGS

The embodiments of the invention will now be described by way of example, reference being made to the accompanying drawings in which:

FIG. 1 illustrates the flow chart of the present invention.

Figure 2:
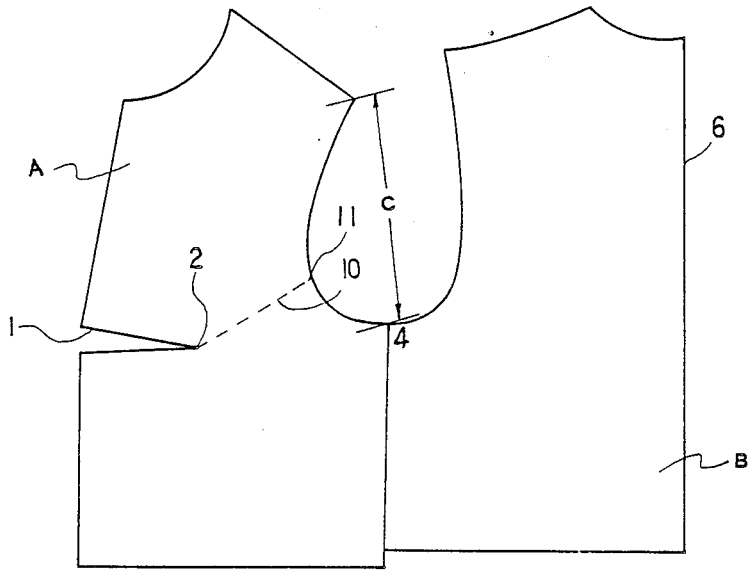
FIG. 2 illustrates a pattern of a basic model for upper garment.
Figure 3:
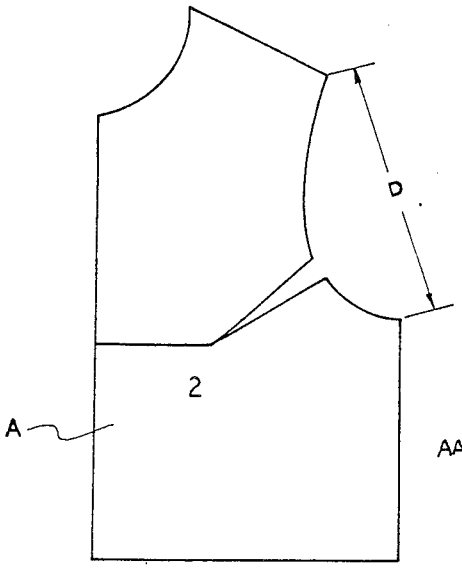
FIG. 3 illustrates the completion of the important steps for the front piece of the pattern of a basic model for an upper garment.
Figure 4:
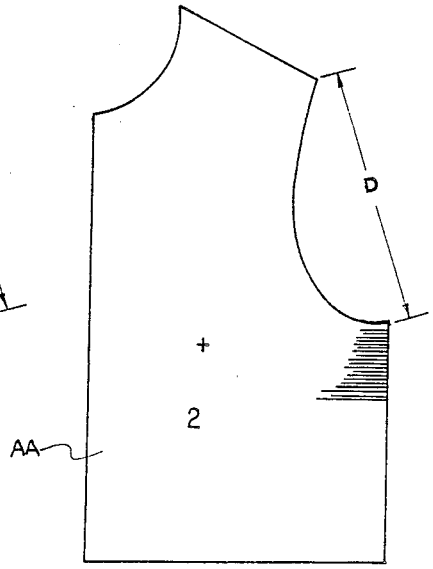
FIG. 4 illustrates a front piece of the dress tailored according to the pattern.
Figure 5:
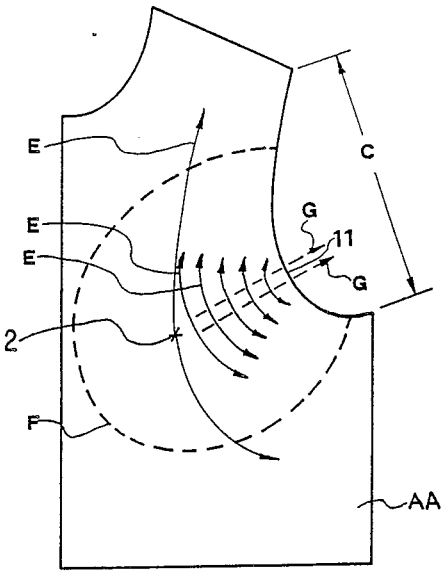
FIG. 5 illustrates the permanent press procedure on a front piece.
Figure 6:
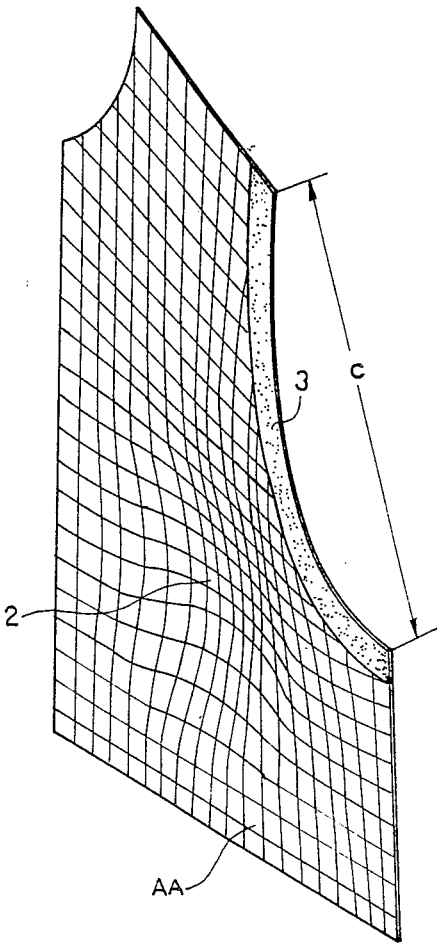
FIG. 6 illustrates the determination of the front piece after the permanent press procedure is completed.
Figure 7:
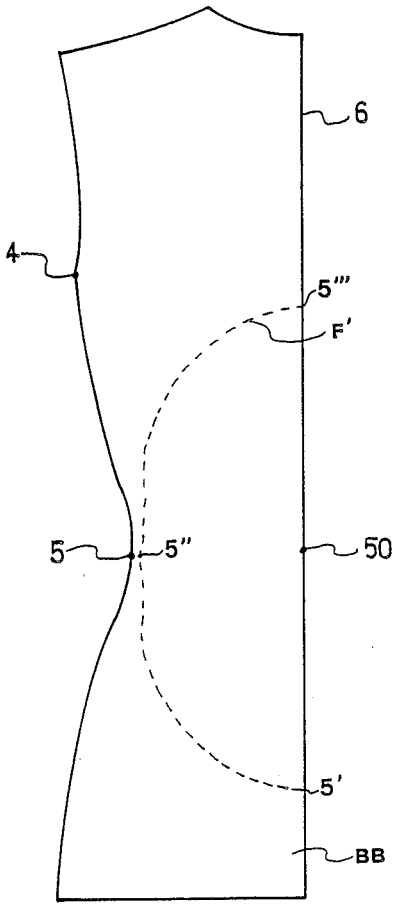
FIG. 7 illustrates a back piece tailored according to the pattern.

CODES (A) ½ of the pattern of the front piece
(B) the pattern of the back piece
(AA) front piece of the fabric
(BB) back piece of the fabric (C) original distance between the armpit opening extremities
(D) the widened distance between the two extremities of the armpit opening before processing
(E) the direction of the ironing for stretching
(F) warming and wetting area
(G) the last permanent press direction
(1) bust dart opening
(10) cutting line of the pattern
(2) bust point
(11) armpit point
(3) false crease (self-adhesive lining)
(4) back armpit point or extremity
(5) waist line center
(6) back center (folding line)
(50) a point on the center of the waistline on the back folding line.

Referring to the flow chart of the present invention as shown in FIG. 1, the front piece of the pattern used in the present invention is tailored according to the pattern of the basic model for upper garment as shown in FIG. 2 which is also created by the present inventor; the bust dart opening of the basic model for upper garment (A) is arranged in the front center of the pattern.

According to conventional tailoring, a cut and seam at the armhole area or at a certain area below the armhole is performed so as to form a bust curvature. The present invention, however, envisages in the most general terms a bust dart-free tailoring process for a fitted-waist dress having armpits, made of a woven cloth having warp and weft yarns, and designed so as to eliminate cutting of the back piece, which includes steam warming and wet-treating a predetermined area of the woven cloth to make the warp and weft yarns more flexible for subsequent realignment thereof. Then a prearranged point is set within the predetermined area to serve as curvature centroid. Thereafter stretch-ironing bilaterally and outwardly from a line connecting a preselected point with a preselected armpit point along curvature paths conforming with the curvature centroid is carried out and thereafter the warp and weft yarns within the predetermined area are heat treated so as to re-align the yarns toward the prearranged point. Subsequently one-way permanent-pressing on at least a pre-arranged area of the cloth towards the preselected armpit point is carried out so as to let at least a preselected portion of the cloth form a preselected curvature.

More specifically, and as shown in FIGS. 2–6, the bust dart-free tailoring process for a fitted-waist dress includes a front piece (A) pattern having a wedge-shaped bust-dart opening with an apex or bust point (2), defining therebetween an upper half piece pattern and a lower half piece pattern and a back pattern piece (B), the front pattern piece (A) and the back pattern piece (B) each being formed with an armpit defining two extremities. The dress is made of a woven cloth having warp and weft yarns. The process is designed so as to eliminate cutting of the back piece (B).

The process includes the novel steps of drawing a straight line (10) from the bust point (2) to the armpit point (11) on the pattern front piece (A) located between the extremities, thereafter cutting the straight line (10) so as to define a cutting line. Then the entire pattern front piece (A) of the garment is made by pivoting the upper half piece around the bust point (2) so as to close the bust-dart opening, merging the half-pieces, widening the initial cutting line to a gap, and widening the initial distance (C) defined between the two extremities of the armpit on the front piece (A) of the pattern to a distance (D). Then the pattern piece (A) is placed over the fabric to form the front of the garment (AA). The fabric piece is then cut according to the pattern piece, the bust point is marked on the fabric piece and the pattern is then removed. Thereafter on the tailored front piece (AA) an area (F) is outlined as shown by the dotted line bordered by the armpit line on FIG. 5, with an approximately truncated oval shape, taking the bust point (2) as the center of the oval shape, one radius thereof almost bordering the vertical edge of the tailored front piece (AA). The longer axis (G) of the oval intersects the curved armpit line between the extremities. Thereafter warming and wetting the truncated oval area (F) is carried out so as to make the warp yarns and weft yarns of the woven cloth more flexible for subsequent re-alignment, defining bilateral part-circular paths in the directions (E). Subsequently the warp and weft yarns are gathered towards the armpit point (11) by pressing bilaterally with respect to the initial cutting line (10) along the part-circular paths (E) within the truncated oval area (F) between the bust point (2) and the armpit line, while regarding the armpit point (11) as a curvature centroid. Subsequently a one-way stretched ironing and pressing procedure in the area between the bust point (2) and the armpit point (11) is carried out along directions (G) approximately parallel with the initial cutting line (10), and the stretched ironing and pressing steps are repeated until the distance (D) shrinks to the original distance (C). Finally, a false crease (3) is placed along the armpit line so as to permanently secure the distance (C), thereby obtaining a completely tailored front piece.

Further steps, as shown in FIG. 2, 7–9, include drawing, from the lower extremity (4) of the back armpit opening on the back piece pattern (B) a downwardly and inwardly directed convexly curved line, in accordance with the transverse dimension required at the waistline for a wearer of the dress. To form the back piece (BB), pattern piece (B) is laid over the cloth and the latter is cut according to pattern (B). The inwardmost point on the convexly curved line is defined as the waistline center point (5), while a downwardly directed straight line on the back piece (BB) opposite the convexly curved line is defined as a back central line (6). Thereafter a back central point (50) transversely opposite to the waistline center point (5) is set and then a semi-oval area (F') is outlined on the back piece (BB). This area F' is further defined by a first point (5') on the back central line (6), which point (5') is set thereon downwardly from the point (5) to about 1.5 times the distance between the waistline center point (5) and the back central line point (50). A second point (5'') is spaced slightly rightwardly from the waistline center point (5) extending from point (5) to point (50). A third point (5''') is on the back central line (6) and extends upwardly from the point (50) to about 1.5 times the distance between the waistline center point (5) and the back central point (50).

Figure 8:
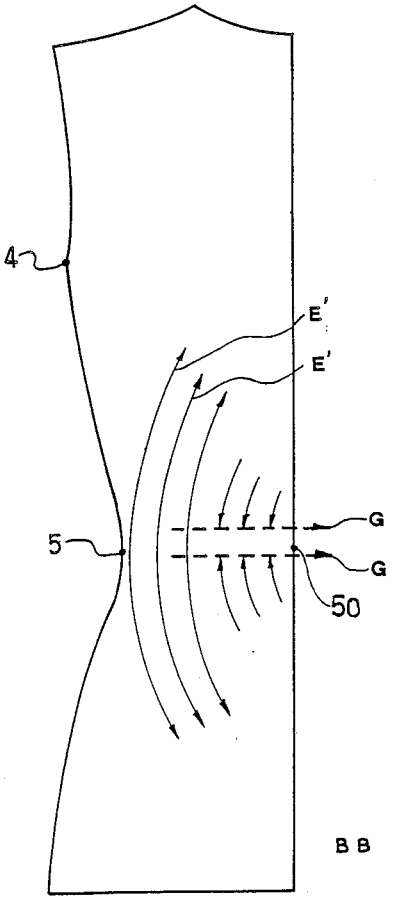
FIG. 8 illustrates the permanent press procedure on the back piece of an upper garment.
Figure 9:
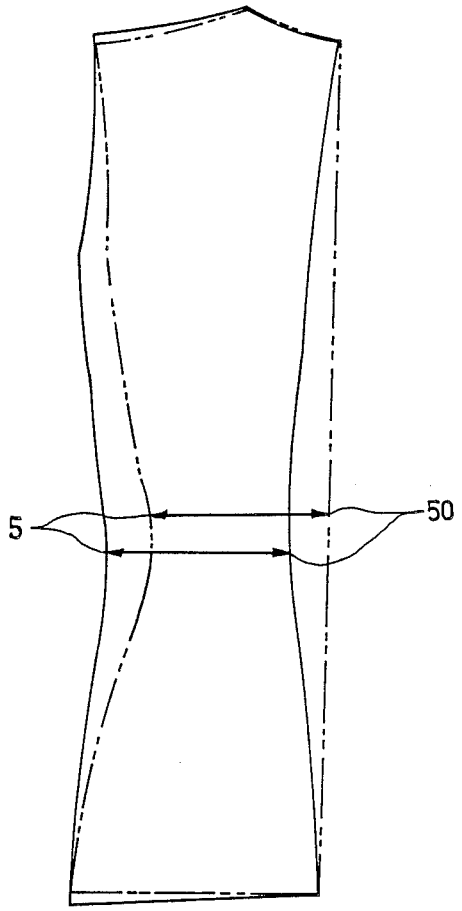
FIG. 9 illustrates the back piece of an upper garment after permanent pressing is completed.

Thereafter, as shown in FIG. 8 one proceeds bilaterally with respect to the direction line (G'), defined between the back central line point (50) and the waistline center point (5) with a steam-warming and wetting treatment along part-circular paths (E') on the semi-oval area (F'). Thereafter one proceeds bilaterally with respect to the direction line (G') with a shrinking and pressing treatment in a manner similar to the steam-warming and wetting treatment near the back central line point (50), so as to shift an area near the convexly curved line leftwardly as shown in FIG. 9 so as to let the warp and weft yarns be gathered towards the back central line (50). Then one proceeds with a one-way permanent press-treatment so as to realign the back central line (6) as shown in FIG. 9. The back central line 6 is realigned by pressing bilaterally leftwards. The shift of the back central line creates a curved area near point 50.

According to the present invention, the preferred curvature can be obtained without any change in the distance between the waistline point (5) and the point (50).

This new tailoring procedure has completely changed the conventional cutting and seaming procedure so as to provide a proper curved line and further, the present invention has also completely eliminated the stitching of the crossed and twisted cloth weave at the back central line. In general, the bust dart-free dress tailoring process to eliminate back cutting for a fitted waist according to the present invention as described above has proved practical. Further, any application and variation resulting from the concept of the present invention should also be included into the category of the present application.

I claim:

1. A bustdart-free tailoring process for a fitted-waist dress from a pattern including a front piece (A) having a bust-dart opening defining therebetween an upper half piece and a lower half piece of said pattern and a back piece pattern, (B), the front piece (A) and the back piece (B) each being formed with an armpit defining two extremities, said dress being made of a woven cloth having warp and weft yarns, and designed so as to eliminate cutting of the back piece (B), which comprises the steps of:

preparing the front piece pattern (A) having the armpit extremities, said pattern (A) having a wedge shaped bust dart opening with an apex bust point (2), drawing a straight line (10) from said bust point (2) to an armpit point (11) on said front piece (A) and located between said extremities, cutting the straight line (10) so as to define a cutting line on said pattern, pivoting said upper half piece around said bust point (2) so as to close said bust-dart opening, merging said upper half and said lower half-piece, widening said initial cutting line to form a gap, widening the distance (C) defined between said two extremities of the armpit on said front piece (A) to a distance (D), placing said pattern (A) on said woven cloth, thereby obtaining a tailored front piece (AA), outlining on said tailored front piece (AA) of the fabric an area (F) of approximately truncated oval shape, taking said bust point (2) as the center of said oval shape, one radius thereof almost bordering the vertical edge of said tailored front piece (AA), the longer axis of said truncated oval shape intersecting the curved armpit line between said extremities;

warming and wetting said truncated oval area (F) so as to make the warp yarns and weft yarns of said woven cloth more flexible for subsequent re-alignment;

defining bilateral part-circular paths along directions (E) along a portion of said truncated oval area (F) between said bust point (2) and said armpit extremities, regarding said armpit point (11) as a curvature centroid;

gathering the pile and weft yarns towards said armpit point (11) by pressing bilaterally with respect to said cutting line (10) along said part-circular paths along directions (E) within said truncated oval area (F) and subjecting said truncated oval area (F) to a heating treatment, proceeding with a one-way stretched ironing and pressing procedure from said bust point (2) to said armpit point (11) along directions (G) approximately parallel with said initial cutting line (10), repeating said stretched ironing and pressing procedure until said distance (D) shrinks to said distance (C), placing a false crease (3) along said armpit line so as to permanently secure said distance (C), thereby obtaining a completely tailored front piece of the garment.

2. A bustdart-free tailoring process for a fitted-waist dress from a pattern including a front piece (A) and a back piece (B), the front piece (A) and the Back piece (B) each being formed with an armpit defining two extremities, said dress being made of a woven cloth having warp and weft yarns, and designed so as to eliminate cutting of the back piece, comprising the steps of:

preparing the back piece (B) pattern with point (4) at the lower extremity of the armpit opening and with central line (6), drawing from said lower point (4) on said back piece (B) a downwardly and inwardly directed convexly curved line, in accordance with the transverse dimension required at the waistline for a wearer of said dress, the most inward point on said convexly curved line being defined as a waist line center point (5), laying the pattern piece (B) on the woven cloth to obtain the back garment piece (BB), setting a back central line point (50) transversely opposite to said waist line center point (5), outlining a semi-oval area (F') on said back piece (BB) defined by a first point (5') on said back central line (6) and extending from the point (50) downwardly to about 1.5 times the distance between said waistline center point (5) and said back central line point (50), by a second point (5'') spaced slightly rightwardly along the line (5)–(50) from said waistline center point (5), and by a third point (5''') on said back central line (6), and extending upwardly from the point (50) to about 1.5 times the distance between said waistline center point (5) and said back central point (50), proceeding bilaterally with respect to a direction line (G') defined between said back central line point (50) and said waist line center point (5) with a steam-warming and wetting treatment along part-circular paths (E') on said semi-oval area (F'), with a shrinking and pressing treatment in a manner similar to said steam-warming and wetting treatment near said back central line point (50), so as to shift an area near said convexly curved line leftwardly, and so as to let the warp and weft yarns be gathered towards said back central line point (50), and thereafter proceeding with a one-way permanent press-treatment along said direction (G'), so as to realign said back central line (6) near the area of said central line point (50) along a predefined curvature extending leftwardly of said back central line (6), thereby completing the entire treated back piece (BB).

* * * * *